US006724307B1

(12) United States Patent
Siegel

(10) Patent No.: US 6,724,307 B1
(45) Date of Patent: Apr. 20, 2004

(54) FLEXIBLE MERCHANDISE SECURITY ELEMENT

(75) Inventor: Georg Siegel, Bergkamen (DE)

(73) Assignee: Georg Siegel Gesellschaft mit beschränkter Haftung zur Verwertung von gewerblichen Schurtzrechten, Kamen (DE)

( * ) Notice: Subject to any disclaimer, the term of this patent is extended or adjusted under 35 U.S.C. 154(b) by 0 days.

(21) Appl. No.: 09/576,814

(22) Filed: May 23, 2000

(30) Foreign Application Priority Data

May 25, 1999 (DE) ..... 199 23 861

(51) Int. Cl.[7] ..... G08B 13/14

(52) U.S. Cl. ..... 340/572.1; 340/572.4; 340/572.5; 340/572.6; 340/572.7; 340/572.8; 340/551

(58) Field of Search ..... 340/572.1, 572.5, 340/572.6, 551, 572.7, 572.8, 572.2, 572.3, 572.4

(56) References Cited

U.S. PATENT DOCUMENTS 5,010,320 A * 4/1991 Cordery ..... 340/551
5,355,120 A * 10/1994 Ferguson et al. ..... 340/572.1
5,420,569 A * 5/1995 Dames et al. ..... 340/572
5,508,684 A * 4/1996 Becker ..... 340/572.1
5,565,847 A * 10/1996 Gambino et al. ..... 340/572
5,602,527 A * 2/1997 Suenaga ..... 340/551
5,854,589 A * 12/1998 How et al. ..... 340/551
5,969,612 A * 10/1999 Gadonniex et al. ..... 340/572.6
6,067,015 A * 5/2000 Lian et al. ..... 340/572.1

* cited by examiner

*Primary Examiner*—Jeffery Hofsass
*Assistant Examiner*—Daniel Previl
(74) *Attorney, Agent, or Firm*—Smith, Gambrell & Russell LLP

(57) ABSTRACT

Security elements that are flexible, that can be used for merchandise and preferably can remain on the merchandise, that are difficult to locate, that can be incorporated into the merchandise during its manufacture and that have a simple design, i.e., merchandise security elements that can be economically produced and used. A merchandise security element which is intended for use in connection with acoustomagnetic merchandise security systems formed of a flat section of a swingable metal foil and a flexible, magnetic metal foil which are arranged in an overlapping fashion within a predetermined surface region and which are fixed relative to one another by means of a non-conductive spacer that cannot be magnetized and is arranged in between the two metal foils within the overlapping surface region.

9 Claims, 1 Drawing Sheet

FLEXIBLE MERCHANDISE SECURITY ELEMENT

INTRODUCTION AND BACKGROUND

The present invention relates to a flexible merchandise security element that is intended for use in connection with acoustomagnetic merchandise security systems.

In the technology for the security of merchandise, the entryways of certain areas are scanned by transmitting/receiving units. The security elements generate a defined reflection of the transmitted frequencies that is registered by the receivers and then made available for evaluation. During the evaluation, signals can be generated or access to certain areas can be blocked or granted.

Merchandise security elements of this type which are used in so-called acoustomagnetic systems and also referred to as AM labels are generally known and broadly used. They are used to identify merchandise that has been applied with such labels or that have such labels incorporated into the merchandise.

Previously known AM labels-consist of a plastic housing, a metal plate and a magnetic plate. The magnetic plate has a north-south polarization, and the metal plate is positioned at a precisely defined distance from the magnetic plate. The dimensions of both plates are also exactly defined. Tolerances are on the order of tenths of a millimeter.

Acoustomagnetic system locks which consist of transmission and reception units detect the resonance of such labels at a frequency of approximately 58 kHz and are triggered. In order to prevent the triggering caused by these labels, high a.c. currents are generated by large copper coils that erase the north-south pole structure on the magnetic strip. Consequently, the acoustomagnetic system locks no longer respond.

However, labels of this type can be very easily manipulated. Such a manipulation may, for example, consist of a malicious deactivation.

Merchandise security elements which are used in acoustomagnetic merchandise security systems usually consist of a permanent magnet and a pivotable metal plate, so-called Metglass. Conventional merchandise security elements are available in the form of so-called labels that, for example, have dimensions of approximately 1×4 cm and are resistant to bending. Labels of this type are stiff and not suitable for use on soft, flexible merchandise, e.g., textiles and the like. In addition, it is easy to ascertain the position of these known labels, i.e., these labels can be manipulated. For example, the magnetic properties can be purposefully altered or the labels can be mechanically destroyed. When used in the textile industry, labels of this type must be removed because they would otherwise affect the intended use of the textiles.

Based on this state of the art, it is according to an object of the present invention to provide merchandise security elements that are flexible, that preferably can remain on the merchandise, that are difficult to locate, that can be incorporated into the merchandise during its manufacture and that have a simple design, i.e., and which can be economically produced and used.

SUMMARY OF THE INVENTION

The above and other objects of the present invention can be attained with a merchandise security element that is intended for use in connection with acoustomagnetic merchandise security systems, and which comprises a flat section of a swingable metal foil and a flexible, magnetic metal foil which are arranged in an overlapping fashion within a predetermined surface region and which are fixed relative to one another by means of a non-conductive spacer that cannot be magnetized and is arranged in between the two metal foils within the overlapping surface region.

The merchandise security element according to the invention is formed exclusively of flexible materials. The term "flexible" in the sense of the present invention pertains to the ability to bend the materials. The merchandise security element comprises two foil sections that are arranged at a predetermined distance from one another, where one overlaps the other within a predetermined region. In order to ensure the overlapping region and the mutual distance between the two foils, a spacer is arranged between the two foils, and the foils are fixed in this position.

BRIEF DESCRIPTION OF DRAWINGS

The present invention will be further understood with reference to the drawings, wherein.

DETAILED DESCRIPTION OF THE INVENTION

Figure 1:
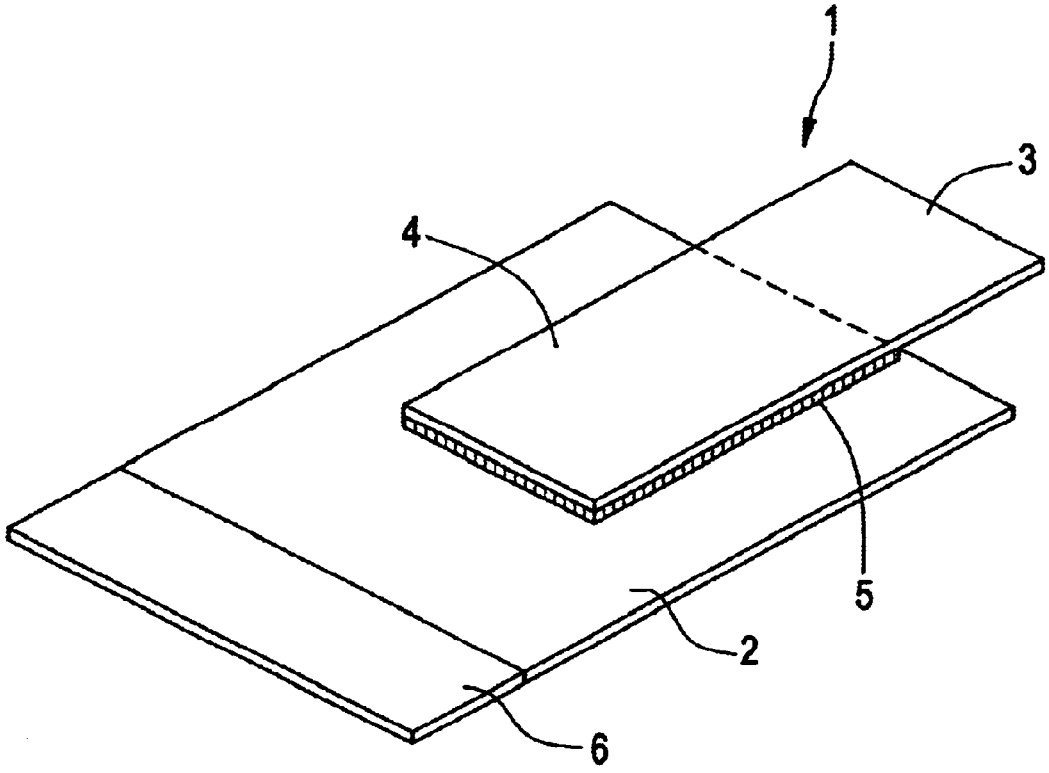
FIG. 1 is a schematic perspective view of one embodiment of the merchandise security element of this invention.
Figure 2:
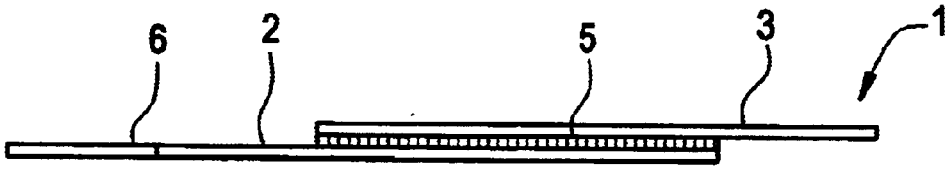
FIG. 2 is a schematic side view of the merchandise security element shown in FIG. 1.

The present invention will now be described in further detail.

One particular advantage of the security element is the fact that it can be bent, i.e., the merchandise security element is flexible and consequently can also be used in soft, flexible merchandise. It is difficult to ascertain the position of the security element, i.e., it cannot be directly manipulated. Due to the materials used, the magnetic properties also cannot be easily manipulated. Since the position of the merchandise security element cannot be easily ascertained, the risk of mechanical destruction is also minimized. The merchandise security element can be incorporated during the manufacture of the merchandise, i.e., sewn into textiles and the like.

According to one advantageous embodiment of the invention, the new merchandise security element contains a fastening element. This may, for example, pertain to a material strip that does not affect the function of the element and is sewn directly into a seam of the textile. It would also be possible to provide a series of fastening elements. The merchandise security element may be arranged on a textile strip. The textile strip may also be arranged between the two foils as the spacer. According to an advantageous embodiment of the invention, the spacer is simultaneously used to fix the two foils relative to one another with respect to the overlapping surface as well as the mutual distance between both foils. The spacer and the fixing agent preferably are formed of plastic, textile or the like. For example, the spacer may be an adhesive that can simultaneously fix the mutual distance between the two foils and the overlapping surface between the two foils. Suitable adhesives will be known to those skilled in the art.

The mutual distance and the overlapping surface, like the sizes of both foils, are defined according to the desired reaction frequency.

In order to minimize mechanical effects on the technical properties of the merchandise security element, the invention uses stabilizing elements. For example, the foils may be provided with stabilizing ribs so as to limit the ability to bend the foils in at least one direction.

The materials, e.g., of the spacer, the fixing agent and the like, can be chosen such that they can be affected by radiation, temperature, water and the like. Due to this measure, individual elements or all elements, e.g., the spacer, the fixing agent, the fastening element, the stabilizing elements and the like, are able to dissolve, melt or the like when the textile is washed, so that the merchandise security element is ultimately destroyed.

In another aspect, the invention also provides solutions for deactivating the merchandise security element described herein. Various options are available for deactivating the merchandise security element according to the invention. The individual foils can be altered with respect to their position, surface or the like; the mutual distance between the foils or the overlapping surface can be altered or several measures can be combined. According to one embodiment of the invention, a deactivating element is formed on the merchandise security element. This deactivating element causes a change in the mutual distance and/or the overlapping surface once it is actuated. The actuation may, for example, take place mechanically by removing or adding material or the like. For example, a hot-melt adhesive may be used as the spacer such that the mutual distance is altered or entirely eliminated under the influence of high temperatures. It would also be conceivable to insert a magnetizable or metallic element into the region between the two foils.

For example, a fabric that increases the resistance to bending, maintains the mutual distance between the foils and fixes the overlapping surface may be used as an intermediate layer between the foils. This textile may contain individual regions that protrude from a seam of the textile merchandise and consequently can be manipulated. The position, the shape or other characteristics can be altered in this case, e.g., by inserting metal springs or the like.

The invention provides a merchandise security element that has a simple design, can be economically produced and broadly used. Although the invention refers to security elements for merchandise, it may also be used for similar purposes, e.g., access authorization, personnel control and the like. These uses of the device of the invention are also contemplated herein if a corresponding acoustomagnetic reaction element which is referred to as a merchandise security element herein is used in an acoustomagnetic security system.

Additional advantages and characteristics of the invention are disclosed below in the description of the figures.

The accompanying drawings show an embodiment of a merchandise security element 1 which comprises a section of swingable metal foil 2 and a section of magnetic foil 3. These two foils are arranged relative to one another in such a way that they have a defined, common overlapping surface 4. The foils are arranged at a predetermined distance from one another. This is achieved with a spacer 5 that is arranged between the two foils. In the embodiment shown, the two foils are fixed in the shown position by the spacer 5. For this purpose, the spacer 5 has adhesive properties at least in the surface region.

The shape and the arrangement of the illustrated embodiment merely serve as an explanation of the invention. The overlapping surface and the mutual distance serve as parameters for the reaction frequency. In the embodiment shown, a fastening strip 6 that, for example, may be sewn into a seam of a textile is arranged on the oscillatory metal foil 2. The fastening strip 6 may be provided with a deactivating rod that protrudes into the region between the foils 2 and 3. Although this arrangement is not shown in the drawings, this deactivating rod can, for example, be pulled out when the fastening strip 6 is torn off.

The flexible merchandise security element 1 can be deactivated in this fashion. The merchandise security element 1 is flexible and can be easily manufactured. In addition, the position of the security element cannot be easily ascertained if it is incorporated into a textile.

The described embodiment merely serves as an explanation of the invention and the invention is not limited to the described embodiment.

Further variations and modifications of the foregoing will be apparent to those skilled in the art and are intended to be encompassed by the claims appended hereto.

German priority application 199 23 861.8 is relied on and incorporated herein by reference.

I claim:

1. A merchandise security element for use in connection with acoustomagnetic merchandise security systems, comprising:

a flat section of swingable metal foil;

a flexible magnetic metal foil; and a non-conductive spacer that cannot be magnetized;

wherein the flat section of swingable metal foil and the flexible magnetic foil are arranged in an overlapping fashion within a predetermined surface region and fixed relative to one another by means of the non-conductive spacer being arranged in between the two metal foils within an overlapping surface region;

wherein the overlapping surface region and/or mutual distance between the two metal foils is defined according to a desired reaction frequency, wherein the spacer is plastic.

2. The merchandise security element according to claim 1 wherein the spacer has adhesive properties and is simultaneously used to fix the two metal foils.

3. The merchandise security element according to claim 1 wherein the two foils are fixed by embedding said foils in a flexible plastic.

4. The merchandise security element according to claim 1, further comprising a deactivating element.

5. The merchandise security element according to claim 4, wherein the deactivating element can be mechanically influenced.

6. The merchandise security element according to according to claim 1, wherein the security element contains stabilizing elements for influencing the flexibility of the foils.

7. The merchandise security element according claim 1, wherein at least one fastening element is arranged on the security element.

8. A merchandise security element for use in connection with acoustomagnetic merchandise security systems, comprising:

a flat section of swingable metal foil;

a flexible magnetic metal foil;

a non-conductive spacer; and a deactivating element;

wherein the flat section of swingable metal foil and the flexible magnetic foil are arranged in an overlapping fashion with a predetermined surface region and fixed relative to one another by means of the non-conductive spacer being arranged in between the two metal foils within an overlapping surface region;

wherein the overlapping surface region and/or mutual distance between the two metal foils is defined according to a desired reaction frequency, wherein the deactivating element causes a change in the mutual distance and/or the overlapping surface between the two foils when actuated.

9. The merchandise security element according to claim 8, wherein the deactivating element can be mechanically influenced.

* * * * *